US005991559A

United States Patent [19]

Suetsugu et al.

[11] Patent Number: 5,991,559

[45] Date of Patent: Nov. 23, 1999

[54] SOLUTE CONCENTRATION CONTROL METHOD AND APPARATUS

[75] Inventors: Junichi Suetsugu; Kazuo Shima; Toru Yakushiji, all of Niigata, Japan

[73] Assignee: NEC Corporation, Japan

[21] Appl. No.: 09/167,887

[22] Filed: Oct. 7, 1998

[30] Foreign Application Priority Data

Oct. 8, 1997 [JP] Japan ..... 9-275944

[51] Int. Cl.[6] ..... G03G 15/10

[52] U.S. Cl. ..... 399/57; 399/58; 399/62; 399/64; 399/65; 118/691

[58] Field of Search ..... 399/53, 57, 58, 399/61, 62, 63, 64, 65, 233, 237, 238; 356/432, 434, 436, 440, 441, 442; 250/573, 574, 576; 222/DIG. 1; 118/691

[56] References Cited

U.S. PATENT DOCUMENTS 3,699,992 10/1972 Knechtel et al. ..... 399/57
4,222,497 9/1980 Lloyd et al. ..... 399/57
4,671,309 6/1987 Iemura et al. ..... 399/57
4,943,735 7/1990 Nishikawa ..... 356/440 X
5,485,276 1/1996 Bien et al. ..... 356/440 X

FOREIGN PATENT DOCUMENTS 62-124567 6/1987 Japan .

*Primary Examiner*—Matthew S. Smith
*Assistant Examiner*—Hoan Tran
*Attorney, Agent, or Firm*—Ostrolenk, Faber, Gerb & Soffen, LLP

[57] ABSTRACT

A control apparatus for controlling a concentration of a solute having a predetermined optical absorption characteristic is disclosed. A cell holding member has a plurality of cells formed therein, one of which is placed at a predetermined detection position so that the solution flows through that cell. A concentration of the solute is detected based on the intensity of light that has passed through the cell placed at the predetermined detection position. A cell changer replaces the cell with another cell by moving the cell holding member when a detected concentration has not changed as expected.

23 Claims, 6 Drawing Sheets

SOLUTE CONCENTRATION CONTROL METHOD AND APPARATUS

BACKGROUND OF THE INVENTION

1. Field of the Invention

The present invention generally relates to concentration control techniques and in particular to method and apparatus for controlling a concentration of a solute in a solution such as a liquid developer by means of optical detection.

2. Description of the Related Art

In an electrostatic recording apparatus using a liquid developer composed of toner and solvent, an electrostatic latent image formed on an image carrier is developed by the liquid developer being in contact with the image carrier. Therefore, it is very important to keep the toner concentration of the liquid developer constant. In general, there has been used a method that detects the toner concentration of the liquid developer and then adjusts it by adding toner to the liquid developer so as to keep the toner concentration constant.

There has been proposed an optically toner concentration detecting technique making use of transmittance of liquid developer in Japanese Patent Unexamined Publication No. 62-124567. More specifically, a transparent pipe through which liquid developer flows is placed between a light source and a photodetector. Based on the output of the photo detector, transmittance of the liquid developer is detected and is used for toner concentration control.

However, there occurs an increase in amount of toner adhering to the inner surface of the transparent pipe with the passage of time and thereby the transparent pipe becomes a factor that substantially influences the toner concentration measurement of the liquid developer, resulting in a lower degree of measurement accuracy.

There has been also proposed another optically toner concentration detecting technique making use of electrophoresis. A pair of electrodes is provided within the liquid developer reservoir and a predetermined voltage is applied thereto. This causes toner particles to move and adhere to one of the electrodes due to the electrophoresis. By detecting the toner adhering to the electrode, the toner concentration of the liquid developer can be obtained.

However, such a toner concentration detecting apparatus making use of electrophoresis needs a power supply for supplying power to the electrodes, resulting in increased amount of hardware and thereby increased cost.

SUMMARY OF THE INVENTION

An object of the present invention is to provide solute concentration control method and apparatus that can detect the concentration of a solute with reliability and stability.

According to an aspect of the present invention, an apparatus for controlling a concentration of a solute having a predetermined optical absorption characteristic is provided with a cell holding member having a plurality of cells formed therein, one of which is placed at a predetermined detection position so that the solution flows through that cell. A concentration of the solute is detected based on light that has passed through the cell placed at the predetermined detection position. The apparatus is further provided with a cell changer for replacing the cell with another cell among the cells by moving the cell holding member when detected concentration has not changed as expected.

According to another aspect of the present invention, a concentration of the solute is adjusted to keep a detected concentration of the solute within a proper concentration range and, when a detected concentration has not changed as expected, the cell is replaced with another cell among the cells by moving the cell holding member. The cell may be replaced with another cell when a detected concentration does not change toward the proper concentration range after the concentration of the solute has been adjusted.

DETAILED DESCRIPTION OF THE PREFERRED EMBODIMENTS

Hereinafter, taking a liquid developer for use in a liquid developing electrostatic recording apparatus as an example, the preferred embodiments of the present invention will be described. The liquid developer is a solution of toner particulate and solvent and has a particular characteristic of absorption line.

Figure 1:
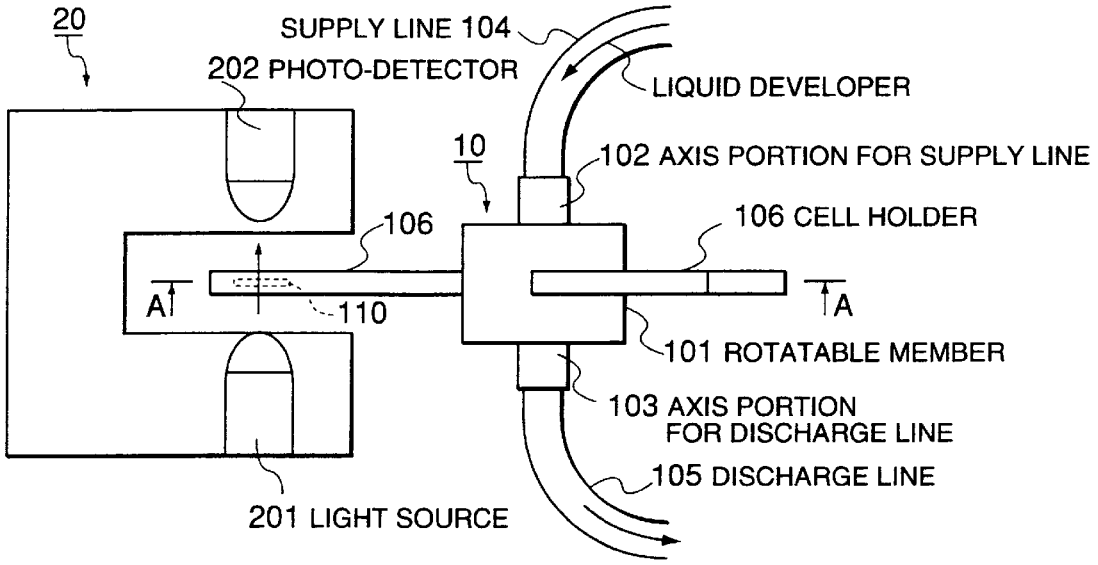
FIG. 1 is a plan view of a toner concentration detecting apparatus according to a first embodiment of the present invention.

Referring to FIG. 1, a toner concentration detecting apparatus is comprised of a cell replacement mechanism 10 and an optically detecting part 20 including a toner concentration control circuit (not shown in this figure).

The cell replacement mechanism 10 is comprised of a rotatable member 101 that is rotatably supported by axis portions 102 and 103. The axis portion 102 is connected to a supply line 104 for supplying liquid developer from a liquid developer reservoir (not shown) to the cell replacement mechanism 10. The axis portion 103 is connected to a discharge line 105 for discharging the liquid developer that has passed through the cell replacement mechanism 10 into the liquid developer reservoir.

The rotatable member 101 has a plurality of cell holders 106 fixed on the side thereof. Each cell holder 106 is shaped like a predetermined length of blade extending in the direction of the radius of the rotatable member 101 as shown in FIG. 2.

the optically detecting part 20 includes a light source 201 and a photodetector 202, which provide spacing between them. The transparent portion of each cell holder 106 as described later can be placed at a detection point between the light source 201 and the photodetector 202 so that the liquid developer flowing the transparent portion can be exposed to light emitted from the light source 201 and the light that has been transmitted is detected by the photodetector 202. Each cell holder 106 can be replaced with another cell holder by the rotatable member 101 rotating in steps about the axis portions 102 and 103.

Figure 2:
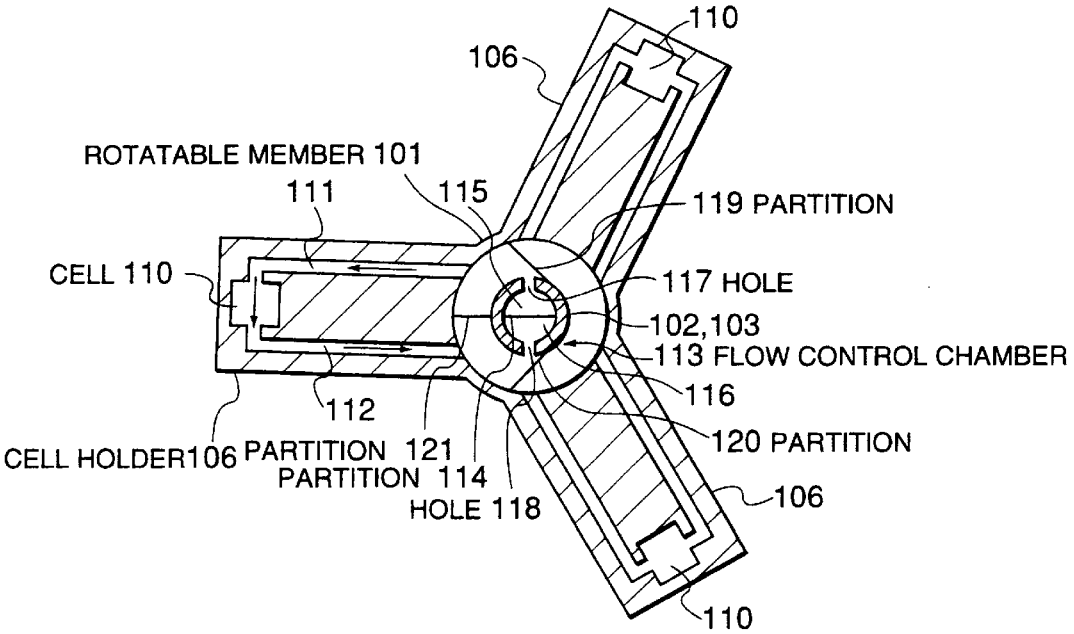
FIG. 2 is a sectional view taken along lines A—A of FIG. 1.

Referring to FIG. 2, three cell holders 106 are fixed to the rotatable member 101 in radial symmetry. Each cell holder 106 has a cell 110 that is a hollow formed in the cell holder 106 at the end portion thereof. The cell 110 has transparent windows (not shown) formed in the top and bottom plates thereof so that the light emitted by the light source 201 can be transmitted through the cell 110. Alternatively, each cell holder 106 may be formed with transparent material.

Each cell holder 106 has a pair of passages 111 and 112 formed therein extending longitudinally. The respective ends of the passages 111 and 112 are coupled to the cell 110 and the other ends are opened. As described later, the liquid developer flows into the cell 110 through the passage 111 and out of the cell 110 through the passage 112.

The rotatable member 101 has a flow control chamber 113 that is a cylindrical-shaped hollow formed therein. There is provided a fixed mechanism within the flow control chamber 113. The fixed mechanism includes axis portions 102 and 103, that are shaped like a tube. A partition 114 is fixed to the inside surface of the axis portions 102 and 103 to divide the cylindrical space defined by the inside surface into two chambers 115 and 116. A supply hole 117 and a discharge hole 118 are formed in the side of the axis portions 102 and 103, respectively. Further, the fixed mechanism includes partitions 119–121 to form a supply chamber and a discharge chamber, as will be described in detail hereinafter.

Figure 3:
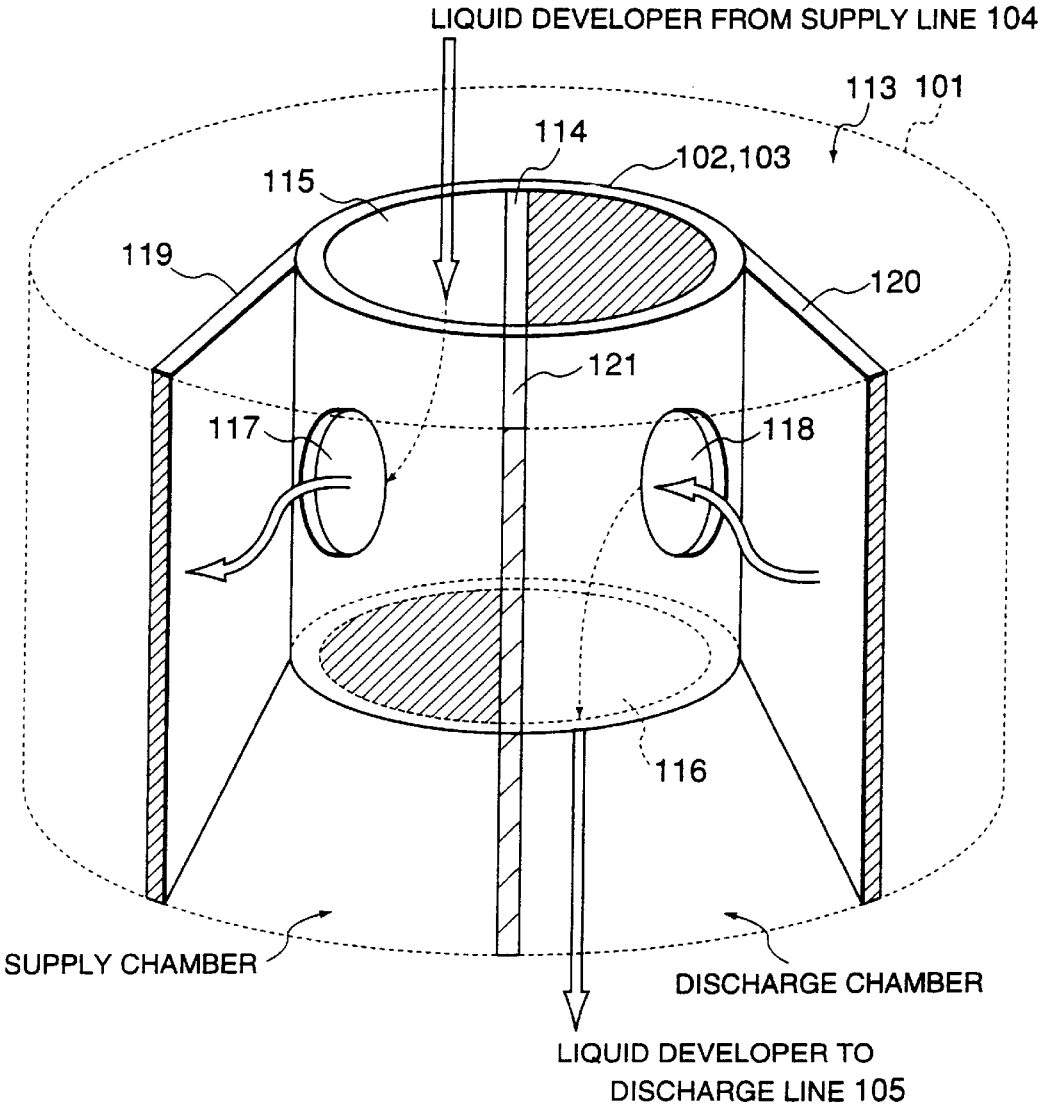
FIG. 3 is a perspective view showing the construction of fixed members provided within a flow control chamber of the first embodiment.

Referring to FIG. 3, the partition 119 is fixed to the one side of the axis portions 102 and 103 at the one end thereof and is in contact with the inside surface of the flow control chamber 113 at the other ends thereof. Similarly, the partition 120 is fixed to the other side of the axis portions 102 and 103 at the one end thereof and is in contact with the inside surface of the flow control chamber 113 at the other ends thereof. The partition 121 is fixed to a center position of the side of the axis portions 102 and 103 at the one end thereof and is in contact with the inside surface of the flow control chamber 113 at the other ends thereof. Such an arrangement forms the supply chamber and the discharge chamber and allows the partitions 119–121 to slide over the inside surface of the flow control chamber 113 while the rotatable member 101 rotating.

By rotating the rotatable member 101 in steps of 120 degrees, as shown in FIG. 2, the three cell holders 106 can be sequentially placed such that the supply passage 111 and the discharge passage 112 are coupled to the supply chamber and the discharge chamber, respectively.

As described above, the cylindrical space within the axis portions 102 and 103 is divided into the chambers 115 and 116. In this embodiment, the one chamber 115 is directly connected to the supply line 104 through the axis portion 102 so that the liquid developer is supplied thereto. The other chamber 116 is directly connected to the discharge line 105 through the axis portion 103 so that the liquid developer is discharged from the chamber 116. Therefore, the supply line 104 is not directly connected to the discharge line 105.

More specifically, as shown in FIG. 3, the liquid developer flows into the chamber 115 through the supply line 104 and flows out of the chamber 115 through the supply hole 117 into the supply chamber. The liquid developer further flows from the supply chamber into the supply passage 111 of one cell holder 106 and flows into the cell 110 through the supply passage 111 as shown in FIG. 2. The liquid developer passes through the cell 110 and further discharge passage 112 into the discharge chamber of the flow control chamber 113. The liquid developer flows out of the discharge chamber through the discharge hold 118 into the chamber 116 and then to the discharge line 105.

By rotating the rotatable member 101 in steps of 120 degrees, one of the three cell holders 106 can be replaced with another one as shown in FIG. 2. As described later, when one cell holder cannot provide reliable concentration detection, it is replaced with another new one by rotating the rotatable member 101 by 120 degrees.

Control Operation

Figure 4:
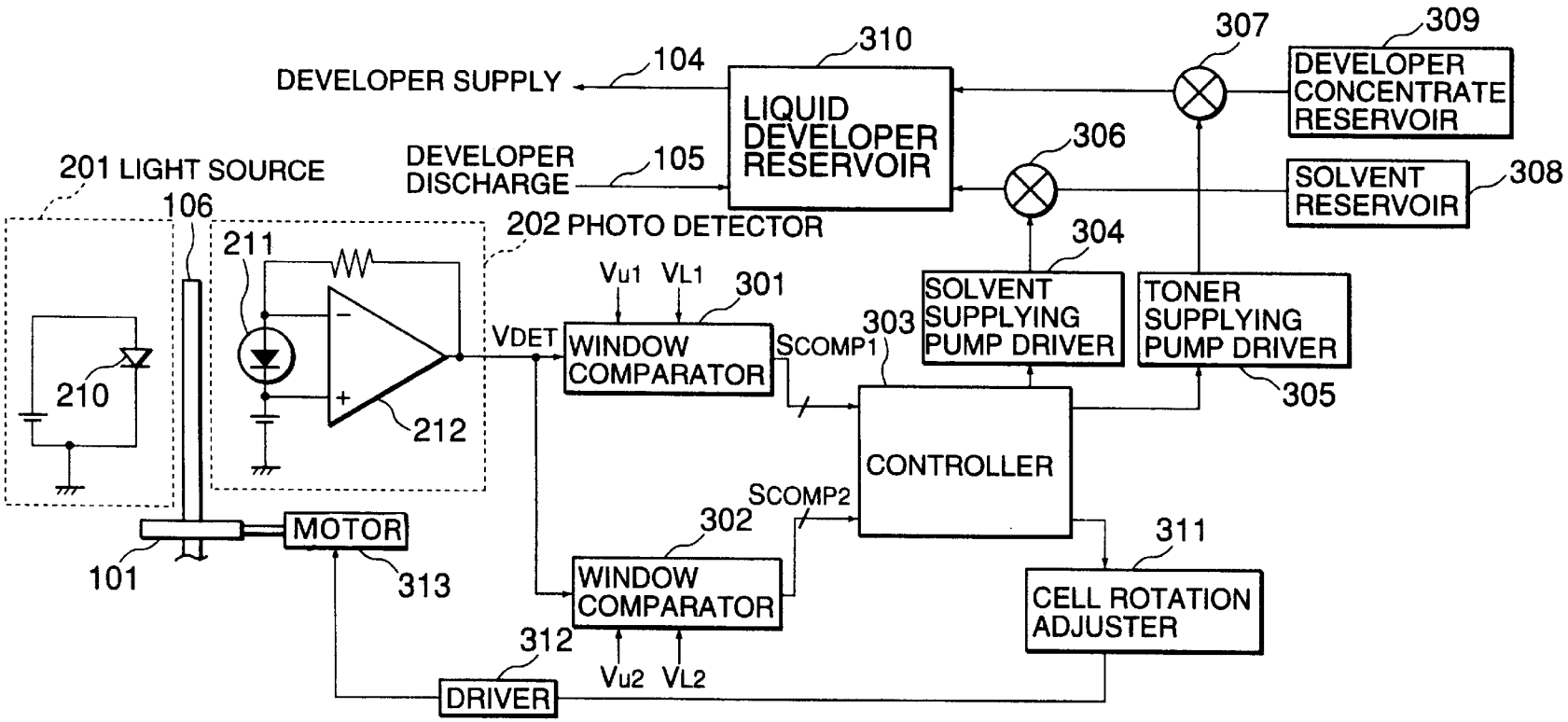
FIG. 4 is a block diagram showing a circuit of the toner concentration detecting apparatus according to the first embodiment.

Referring to FIG. 4, the light source 201 includes a light-emitting device 210 that emits light having a wavelength longer than the absorption line of the liquid developer. A light-emitting diode, a laser diode, or a halogen lamp may be used as the light-emitting device 210. From the viewpoint of power consumption, the laser diode is preferable. In the case where four colors of black, yellow, magenta and cyan are used, it is necessary to set the wavelength of the laser diode 210 to more than the maximum wavelength of the absorption lines of the four color developers.

The photodetector 202 includes a photodiode 211 and an operational amplifier 212 and the photodiode 211 receives light from the laser diode 201 through the cell 110 of the present cell holder 106. The light emitted by the laser diode 210 reduces in intensity due to scattering caused by toner particulate included in the liquid developer in addition to absorption of the toner particulate. Therefore, the intensity of light incident through the liquid developer of the cell 110 varies depending on the amount of toner included in the liquid developer. In other words, a current flowing through the photodiode 211 varies according to toner concentration of the liquid developer, which means that an output voltage $V_{DET}$ of the amplifier 212 can be used as a toner concentration detection signal. The detection voltage $V_{DET}$ is applied to window comparators 301 and 302.

The window comparator 301 compares the detection voltage $V_{DET}$ to both a first upper limit $V_{U1}$ and a first lower limit $V_{L1}$ and outputs a comparison result signal $S_{COMP1}$ to a controller 303. The window comparator 302 compares the detection voltage $V_{DET}$ to both a second upper limit $V_{U2}$ and a second lower limit $V_{L2}$ and outputs a comparison result signal $S_{COMP2}$ to the controller 303. In this embodiment, the window width of the window comparator 301 includes a predetermined voltage range corresponding to a proper concentration range of the liquid developer and is in turn included within that of the window comparator 302.

Based on the comparison result signals $S_{COMP1}$ and $S_{COMP2}$, the controller 303 controls pump drivers 304 and 305 which drive a solvent-supplying pump 306 and toner-supplying pump 307, respectively. The solvent-supplying pump 306 is connected between a solvent reservoir 308 and a liquid developer reservoir 310 and supplies an adjusted amount of solvent to the liquid developer reservoir 310. The toner-supplying pump 307 is connected between a developer concentrate reservoir 309 and the liquid developer reservoir 310 and supplies an adjusted amount of developer concentrate to the liquid developer reservoir 310.

In the case of a color recording apparatus, a liquid developer supplying system composed of the above elements 304–310 may be prepared for each of black and primary colors. In general, four colors of black, yellow, magenta and cyan are used. In this case, it is necessary to set the wavelength of the light source 201 (laser diode) to more than the maximum wavelength of the absorption lines of the four color developers.

The controller 303 further controls a cell rotation adjuster 311 based on the comparison result signals $S_{COMP1}$ and $S_{COMP2}$. The cell rotation adjuster 311 adjusts the rotation of the rotatable member 101 by controlling a driver 312, which drives a motor 313. The motor 313 is mechanically connected to the rotatable member 101 and is controlled such that the rotatable member 101 can rotate in steps of 120 degrees. Alternatively, the rotatable member 101 may be manually rotated.

Figure 5:
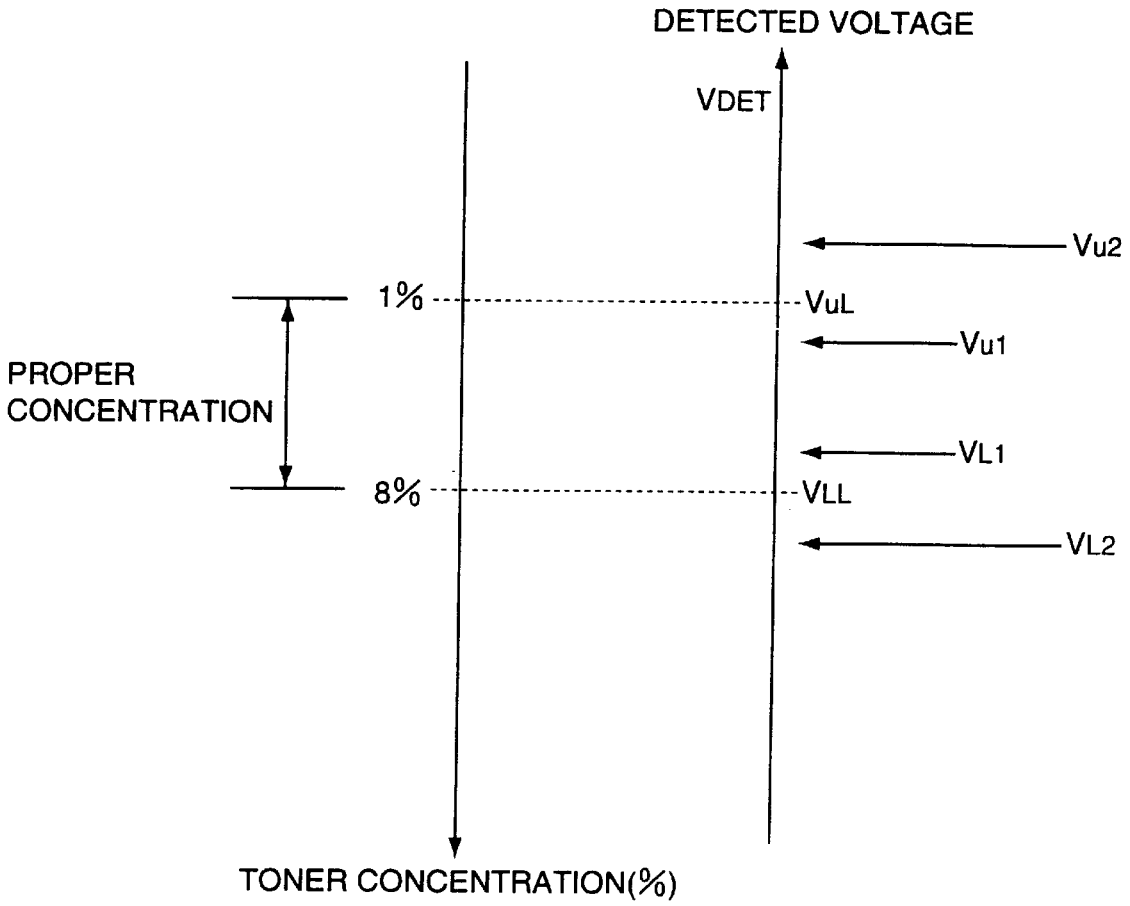
FIG. 5 is a schematic diagram showing an operation of the toner concentration detecting apparatus of FIG. 4.

Referring to FIG. 5, assuming that a proper concentration range of liquid developer extends from 1% to 8%, an upper limit voltage $V_{UL}$ corresponds to the lower limit concentration of 1% and a lower limit voltage $V_{LL}$ corresponds to the upper limit concentration of 8%. As the toner concentration of the liquid developer is higher, the detected voltage $V_{DET}$ becomes lower because the intensity of incident light of the photodiode 211 is smaller.

In the window comparator 301, the first upper limit $V_{U1}$ is set to less than the upper limit voltage $V_{UL}$ and the first lower limit $V_{L1}$ is set to more than the lower limit voltage $V_{LL}$. Contrarily, In the window comparator 302, the second upper limit $V_{U2}$ is set to more than the upper limit voltage $V_{UL}$ and the second lower limit $V_{L2}$ is set to less than the lower limit voltage $V_{LL}$. The control operation will be described in detail hereinafter.

Figure 6:
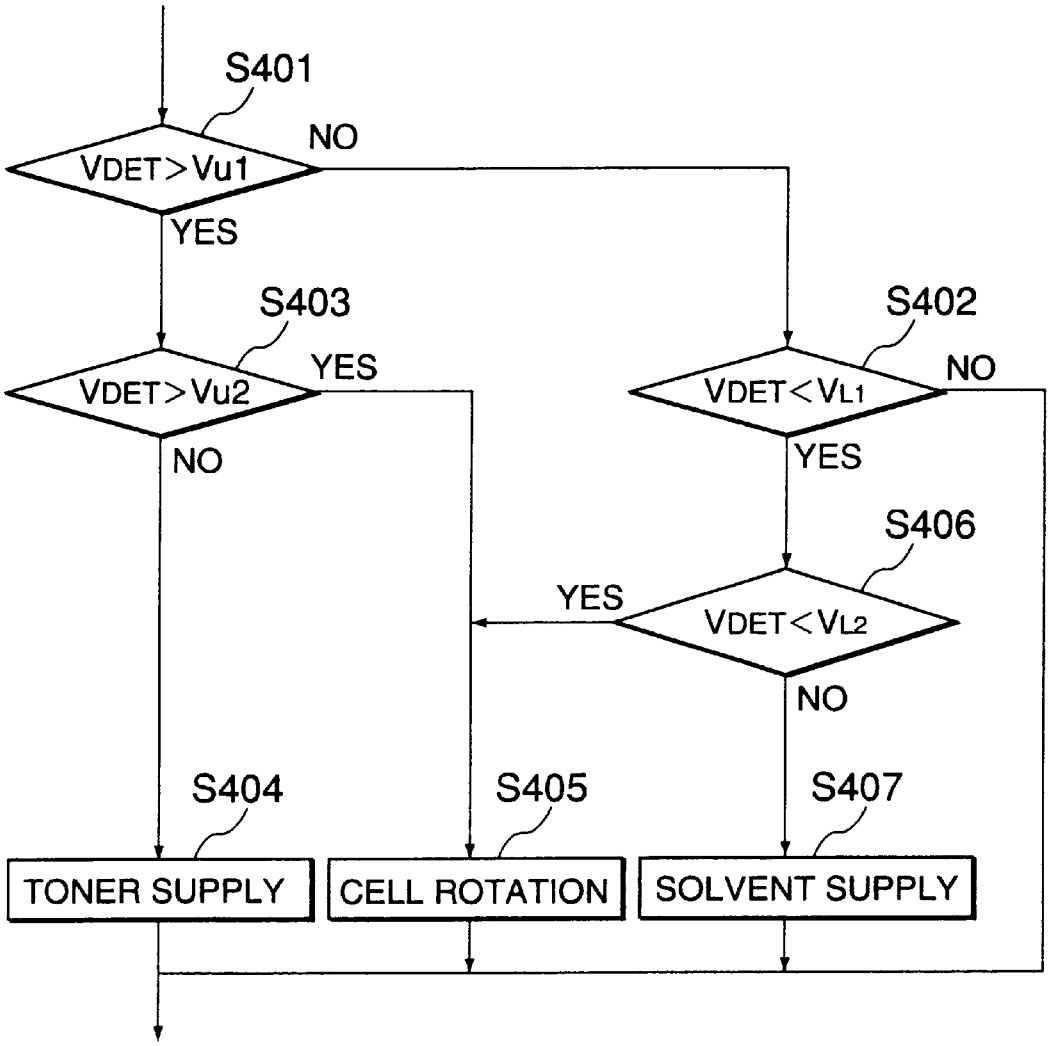
FIG. 6 is a flow chart showing a control flow of the toner concentration detecting apparatus according to the first embodiment.

Referring to FIG. 6, when receiving the comparison result signals $S_{COMP1}$ and $S_{COMP2}$, the controller 303 determines whether the detection voltage $V_{DET}$ is higher than the first upper limit $V_{U1}$ (step S401). Then the detection voltage $V_{DET}$ is equal to or lower than the first upper limit $V_{U1}$ (NO in step S401), it is further determined whether the detection voltage $V_{DET}$ is lower than the first lower limit $V_{L1}$ (step S402). If the detection voltage $V_{DET}$ is not lower than the first lower limit $V_{L1}$ (NO in step S402), then it is determined that the toner concentration of the liquid developer falls into the proper range and therefore no action is taken.

When $V_{DET}>V_{U1}$ (YES in step S401), it is further determined whether the detection voltage $V_{DET}$ is higher than the second upper limit $V_{U2}$ (step S403). If the detection voltage $V_{DET}$ is equal to or lower than the second upper limit $V_{U2}$ (NO in step S403), then it is determined that the toner concentration of the liquid developer decreases to around the lower limit concentration of 1%. Therefore, the controller 303 controls the pump driver 305 so that the developer concentrate is supplied to the liquid developer reservoir 310 (step S404).

If the detection voltage $V_{DET}$ is higher than the second upper limit $V_{U2}$ (YES in step S403), it means that the toner concentration of the liquid developer does not increase even after the developer concentrate has been supplied to the liquid developer reservoir 310 in the step S404. Therefore, it is determined that the cell 110 of the present cell holder 106 becomes dysfunctional and the controller controls the cell rotation adjuster 311 so that the rotatable member 101 rotates by 120 degrees to replace the present cell 110 with another new one (step S405).

When the detection voltage $V_{DET}$ is lower than the first lower limit $V_{L1}$ (YES in step S402), it is further determined whether the detection voltage $V_{DET}$ is lower than the second lower limit $V_{L2}$ (step S406). If the detection voltage $V_{DET}$ is not lower than the second lower limit $V_{L2}$ (NO in step S406), it is determined that the toner concentration of the liquid developer increases to around the upper limit concentration of 8%. Therefore, the controller 303 controls the pump driver 306 so that the solvent is supplied to the liquid developer reservoir 310 (step S407).

If the detection voltage $V_{DET}$ is lower than the second lower limit $V_{L2}$ (YES in step S406), it means that the toner concentration of the liquid developer does not decrease even after the solvent has been supplied to the liquid developer reservoir 310 in the step S407. Therefore, it is determined that the cell 110 of the present cell holder 106 becomes dysfunctional and the controller controls the cell rotation adjuster 311 so that the rotatable member 101 rotates by 120 degrees to replace the present cell 110 with another new one (step S405).

As described above, when the toner concentration of the liquid developer increases to around the upper limit concentration of 8%, the liquid developer is diluted with the solvent. Contrarily, when the toner concentration of the liquid developer decreases to around the lower limit concentration of 1%, the developer concentrate is supplied to the liquid developer. However, in the case where the expected results is not obtained after the above concentration control has been performed, it is determined that the present cell 110 becomes dysfunctional and it should be replaced with a new cell.

Figure 7:
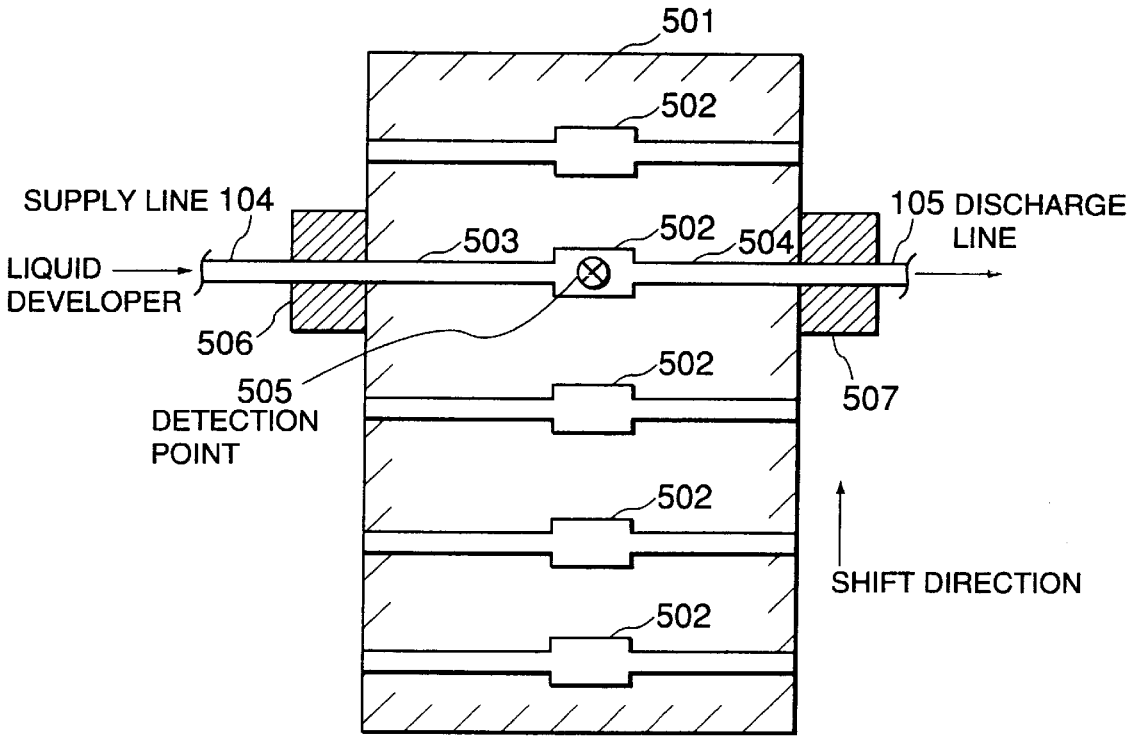
FIG. 7 is a sectional view of a toner concentration detecting apparatus according to a second embodiment of the present invention.

Referring to FIG. 7, there is shown a second embodiment of the present invention. In this embodiment, a cell holder 501 has a plurality of cells 502 arranged in line. Each of cell 502 is coupled to a supply passage 503 and a discharge passage 504 at both ends therefor. The cell holder 501 can be sequentially shifted in a predetermined direction by a shifting mechanism (not shown) so that a selected one of the cells 502 is placed at the detection point 505 between the light source 201 and the photodetector 202. The cell holder 501 is sandwiched between a pair of line holders 506 and 507, which hold the supply line 104 and the discharge line 105, respectively, so that the liquid developer flows from the supply line 104 into the selected cell and flows out of the selected cell into the discharge line 105. The replacement timing of cells 502 is the same as in the first embodiment as shown in FIG. 6.

As described above, when it is determined that a cell for concentration detection is deteriorated, the deteriorated cell is replaced with a new cell. Therefore, the concentration detection can be performed with reliability and stability.

What is claimed is:

1. An apparatus for controlling a concentration of a solute in a solution, the solute having a predetermined optical absorption characteristic, comprising:

a cell holding member having a plurality of cells formed therein, one of which is placed at a predetermined detection position so that the solution flows through that cell;

a detector for detecting a concentration of the solute based on light that has passed through the cell placed at the predetermined detection position; and a cell changer for replacing the cell with another cell among the cells by moving the cell holding member when a detected concentration has not changed as expected.

2. The apparatus according to claim 1, further comprising:

a concentration adjuster for adjusting a concentration of the solute to keep a detected concentration of the solute within a proper concentration range;

wherein the cell changer replaces the cell with another cell when a detected concentration does not change toward the proper concentration range after the concentration of the solute has been adjusted by the concentration adjuster.

3. The apparatus according to claim 1, wherein the detector comprises:

a light source for irradiating light to the cell placed at the predetermined detection position, wherein the light emitted from the light source has a wavelength longer than an absorption wavelength of the solution; and a photodetector for detecting the light transmitted through the cell, wherein an intensity of the light transmitted through the cell is used to detect the concentration of the solute.

4. The apparatus according to claim 3, wherein the light source is a laser diode and the photodetector is a photodiode.

5. The apparatus according to claim 1, wherein the solution is a liquid developer for use in an electrostatic recording apparatus, wherein the liquid developer includes a toner particulate and a liquid solvent.

6. An apparatus for controlling a concentration of a solute in a solution, the solute having a predetermined optical absorption characteristic, comprising:

a cell holding member having a plurality of cells formed therein, one of which is paced at a predetermined detection position so that the solution flows through that cell;

a detector for detecting a concentration of the solute based on light that has passed through the cell placed at the predetermined detection position; and a cell changer for replacing the cell with another cell among the cells by moving the cell holding member when detected concentration has not changed as expected; wherein the cell holding member comprises:

a rotatable member;

a plurality of blade members fixed to the rotatable member at one end thereof in radial symmetry, each of the blade members having a cell formed in the other end portion thereof; and a flow control chamber formed within the rotatable member so that a cell of one of the blade members is placed at the predetermined detection position and the solution flows through the cell.

7. The apparatus according to claim 6, wherein the cell changer comprises:

a rotation actuator for rotating the rotatable member by a predetermined step to replace one cell with another.

8. An apparatus for controlling a concentration of a solute in a solution, the solute having a predetermined optical absorption characteristic, comprising:

a cell holding member having a plurality of cells formed therein, one of which is paced at a predetermined detection position so that the solution flows through that cell;

a detector for detecting a concentration of the solute based on light that has passed through the cell placed at the predetermined detection position; and a cell changer for replacing the cell with another cell among the cells by moving the cell holding member when detected concentration has not changed as expected; wherein the cell holding member comprises:

a plate member movable in one direction, the plate member having the cells arranged in line and further having a pair of passages formed for each cell, the passages for each cell extending in a direction perpendicular to the one direction to both ends of the plate member, respectively; and a solution supplier sandwiching the plate member to couple the passages of a cell placed at the predetermined detection position so that the solution flows through the cell.

9. The apparatus according to claim 8, wherein the cell changer comprises:

an actuator for shifting the plate member in the one direction by a predetermined step to replace one cell with another.

10. An apparatus for controlling a concentration of a solute in a solution, the solute having a predetermined optical absorption characteristic, comprising:

a cell holding member having a plurality of cells formed therein, one of which is paced at a predetermined detection position so that the solution flows through that cell;

a detector for detecting a concentration of the solute based on light that has passed through the cell placed at the predetermined detection position;

a cell changer for replacing the cell with another cell among the cells by moving the cell holding member when detected concentration has not changed as expected;

a concentration adjuster for adjusting a concentration of the solute to keep a detected concentration of the solute within a proper concentration range, wherein the cell changer replaces the cell with another cell when a detected concentration does not change toward the proper concentration range after the concentration of the solute has been adjusted by the concentration adjuster; and further wherein the concentration adjuster comprises:

a first comparator for comparing the detected concentration to a first range to determine whether it falls into the first range, the proper concentration range including the first range; and a concentration controller for controlling the concentration when the detected concentration falls out of the first range, and the cell changer comprises:

a second comparator for comparing the detected concentration to a second range to determine whether it falls into the second range, the second range including the proper concentration range; and a cell change controller for replacing the cell with another when the detected concentration falls out of the second range after it has fallen out of the first range.

11. The apparatus according to claim 10, wherein the cell change controller replaces the cell with another when the detected concentration exceeds a second upper limit of the second range after having exceeded a first upper limit of the first range.

12. The apparatus according to claim 10, wherein the cell change controller replaces the cell with another when the detected concentration becomes below a second lower limit of the second range after having been below a first lower limit of the first range before.

13. The apparatus according to claim 10, wherein the concentration controller controls the concentration of the solute by adding one of the solute and a solvent to a reservoir containing the solution depending on a comparison result of the first comparator.

14. The apparatus according to claim 13, wherein the concentration adjuster adds the solute to the reservoir when the detected concentration lowers below the first lower limit of the first range and adds the solvent to the reservoir when the detected concentration exceeds the first upper limit of the first range.

15. A method for controlling a concentration of a solute in a solution, the solute having a predetermined optical absorption characteristic, comprising the steps of:

a) preparing a plurality of cells formed therein, one of which is placed at a predetermined detection position so that the solution flows through that cell;

b) detecting a concentration of the solute based on light that has passed through the cell placed at the predetermined detection position;

c) adjusting a concentration of the solute to keep a detected concentration of the solute within a proper concentration range; and d) replacing the cell with another cell among the cells by moving the cell holding member when a detected concentration has not changed as expected.

16. The method according to claim 15, wherein in the step d), the cell is replaced with another cell when a detected concentration does not change toward the proper concentration range after the concentration of the solute has been adjusted.

17. The method according to claim 15, wherein the step b) comprises the steps of:

irradiating light to the cell placed at the predetermined detection position, wherein the light emitted from the light source has a wavelength longer than an absorption wavelength of the solution; and detecting the light transmitted through the cell, wherein an intensity of the light transmitted through the cell is used to detect the concentration of the solute.

18. The method according to claim 15, wherein the solution is a liquid developer for use in an electrostatic recording apparatus, wherein the liquid developer includes toner particulate and a liquid solvent.

19. A method for controlling a concentration of a solute in a solution, the solute having a predetermined optical absorption characteristic, comprising the steps of:

a) preparing a plurality of cells formed therein, one of which is placed at a predetermined detection position so that the solution flows through the cell;

b) detecting a concentration of the solute based on light that has passed through the cell placed at the predetermined detection position;

c) adjusting a concentration of the solute to keep a detected concentration of the solute within a proper concentration range; and d) replacing the cell with another cell among the cells by moving the cell holding member when a detected concentration has not changed as expected;

wherein in the step (d), the cell is replaced with another cell when a detected concentration does not change toward the proper concentration range after the concentration of the solute has been adjusted; wherein the step c) comprises the steps of:

c-1) comparing the detected concentration to a first range to determine whether it falls into the first range, the proper concentration range including the first range; and c-2) controlling the concentration when the detected concentration falls out of the first range, and the step d) comprises the steps of:

d-1) comparing the detected concentration to a second range to determine whether it falls into the second range, the second range including the proper concentration range; and d-2) replacing the cell with another when the detected concentration falls out of the second range after it has fallen out of the first range.

20. The method according to claim 19, wherein in the step d-2), the cell is replaced with another when the detected concentration exceeds a second upper limit of the second range after having exceeded a first upper limit of the first range.

21. The method according to claim 19, wherein in the step d-2), the cell is replaced with another when the detected concentration becomes below a second lower limit of the second range after having been below a first lower limit of the first range.

22. The method according to claim 19, wherein in the step c-2), the concentration of the solute is controlled by adding one of the solute and a solvent to a reservoir containing the solution.

23. The method according to claim 22, wherein in the step c-2), the solute is added to the reservoir when the detected concentration lowers below the first lower limit of the first range and the solvent is added to the reservoir when the detected concentration exceeds the first upper limit of the first range.

* * * * *